US010302094B2

(12) United States Patent
Gomes

(10) Patent No.: US 10,302,094 B2
(45) Date of Patent: May 28, 2019

(54) CEILING FAN BLADE ATTACHMENT

(71) Applicant: Carlos Gomes, Mineola, NY (US)

(72) Inventor: Carlos Gomes, Mineola, NY (US)

( * ) Notice: Subject to any disclaimer, the term of this patent is extended or adjusted under 35 U.S.C. 154(b) by 277 days.

(21) Appl. No.: 14/685,092

(22) Filed: Apr. 13, 2015

(65) Prior Publication Data

US 2015/0308450 A1 Oct. 29, 2015

Related U.S. Application Data

(60) Provisional application No. 61/983,881, filed on Apr. 24, 2014.

(51) Int. Cl.

| | |
|---|---|
| ***F04D 29/38*** | (2006.01) |
| ***F04D 25/08*** | (2006.01) |
| *F04D 19/00* | (2006.01) |

(52) U.S. Cl.

CPC ..... *F04D 29/384* (2013.01); *F04D 25/088* (2013.01); *F04D 29/388* (2013.01)

(58) Field of Classification Search

CPC ..... F04D 19/002; F04D 25/08; F04D 25/088; F04D 29/181; F04D 29/325; F04D 29/34; F04D 29/36; F04D 29/382; F04D 29/384; F04D 29/388; F05B 2240/302; F05B 2240/31

See application file for complete search history.

(56) References Cited

U.S. PATENT DOCUMENTS

| | | | | | |
|---|---|---|---|---|---|
| 871,729 | A * | 11/1907 | McChord | B64C 11/065 | 416/207 |
| 4,640,668 | A * | 2/1987 | Yang | F04D 25/088 | 310/68 E |
| 4,662,823 | A * | 5/1987 | Cooke | F04D 29/36 | 416/228 |
| 4,892,460 | A * | 1/1990 | Volk | F04D 29/388 | 416/23 |
| 6,652,234 | B2 * | 11/2003 | MacCuaig | F04D 29/34 | 416/210 R |
| 7,052,524 | B1 * | 5/2006 | Venezzio, Jr. | B01D 46/0005 | 416/146 R |
| 7,815,419 | B2 * | 10/2010 | Teraoka | F04D 29/283 | 416/178 |
| 2001/0016164 | A1 * | 8/2001 | Hodgkins, Jr. | F04D 25/088 | 416/210 R |
| 2006/0024165 | A1 * | 2/2006 | Gajewski | F04D 25/088 | 416/210 R |
| 2009/0297360 | A1 * | 12/2009 | De Rosa | F04D 25/088 | 416/248 |
| 2016/0115969 | A1 * | 4/2016 | Yamashita | F04D 29/384 | 416/228 |

* cited by examiner

*Primary Examiner* — Justin D Seabe
*Assistant Examiner* — Alexander A White
(74) *Attorney, Agent, or Firm* — Dunlap Bennett & Ludwig PLLC

(57) ABSTRACT

An accessory blade attachment adapted to removably attach to a ceiling fan blade of a ceiling fan is provided. The accessory blade attachment may include a blade portion and a pivotally connected fan clip, wherein the fan clip removably attaches to the trailing edge of the ceiling fan blade so that the blade portion may improve the volume and direction of airflow generated by the ceiling fan.

5 Claims, 4 Drawing Sheets

FIG.1
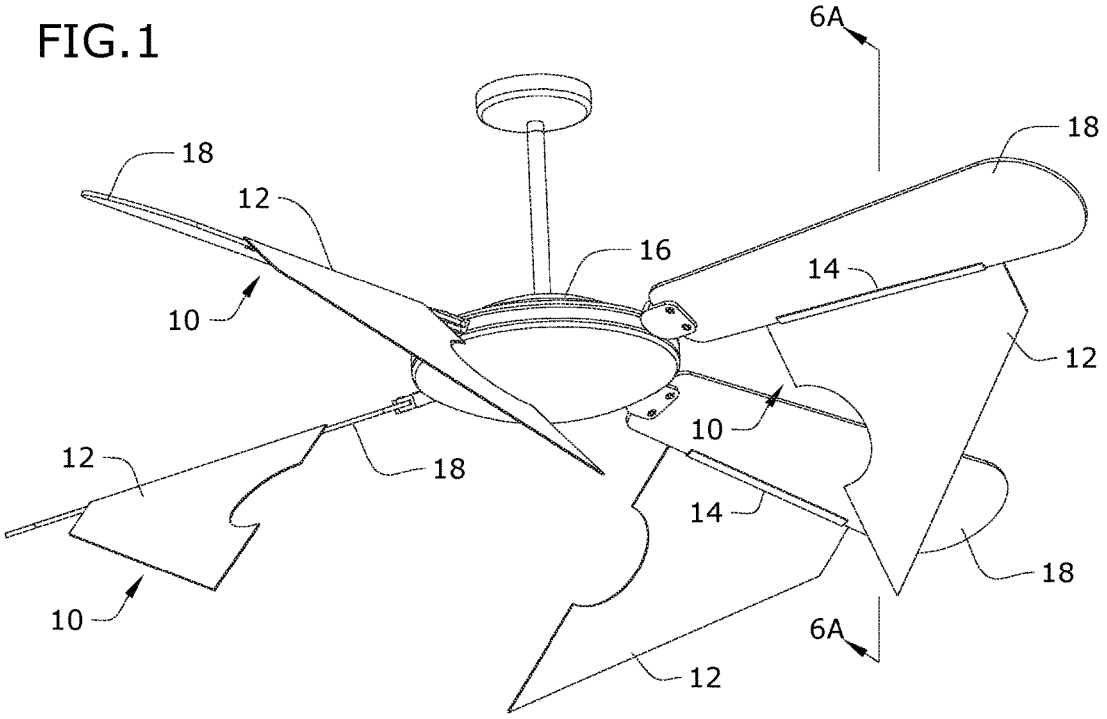
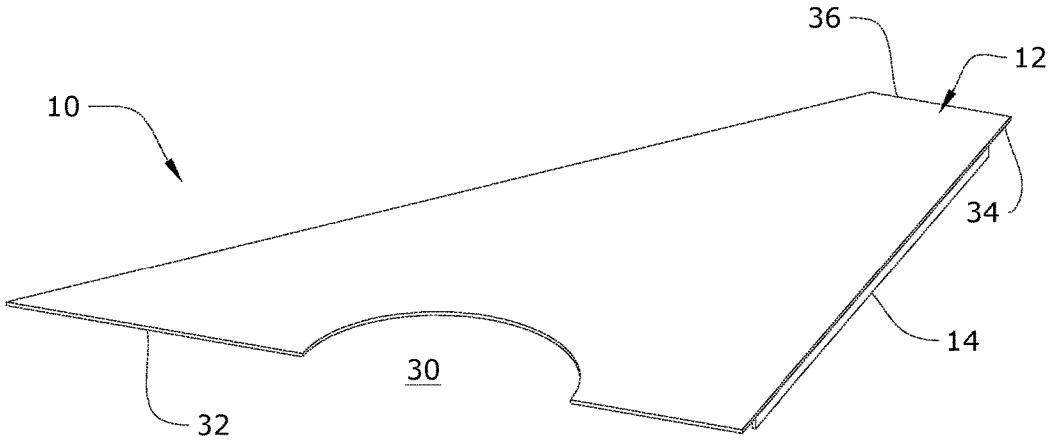
FIG.2

CEILING FAN BLADE ATTACHMENT

CROSS-REFERENCE TO RELATED APPLICATION

This application claims the benefit of priority of U.S. provisional application No. 61/983,881, filed 24 Apr. 2014, the contents of which are herein incorporated by reference.

BACKGROUND OF THE INVENTION

The present invention relates to ceiling fans and, more particularly, to an accessory blade attachment adapted for improving the volume and direction of airflow of ceiling fan blades.

Conventional ceiling fans are inherently limited in the volume and direction of their resulting airflow.

As can be seen, there is a need for an accessory blade attachment adapted for improving the volume and direction of airflow of ceiling fan blades.

SUMMARY OF THE INVENTION

In one aspect of the present invention, a ceiling fan blade attachment includes a blade portion; and a fan clip pivotally connected to the blade portion.

In another aspect of the present invention, a ceiling fan blade attachment, includes a blade portion formed from a sheet of lightweight material that can be repeatedly bent without fracturing, wherein the sheet forms a general right-hand triangular shape having a first leg; a generally half-circular notch along the first leg; a second leg; a hypotenuse; and a top edge extending perpendicularly from the second leg to the hypotenuse; a fan clip disposed along the first leg of the blade portion; and a control pivot between the blade portion and the fan clip.

In yet another aspect of the present invention, a method of redirecting an airflow of a ceiling fan having at least one ceiling fan blade includes providing at least one ceiling fan blade attachment, wherein each fan blade attachment comprises a blade portion; a fan clip disposed along a periphery of the blade portion; and a control pivot between the blade portion and the fan clip; attaching each fan clip to a trailing edge of the at least one ceiling fan blade; and urging each blade portion about the control pivot to a predetermined angle of incidence relative to said at least one ceiling fan blade so that the airflow is redirected to a desired location. These and other features, aspects and advantages of the present invention will become better understood with reference to the following drawings, description and claims.

BRIEF DESCRIPTION OF THE DRAWINGS

FIG. 1 is a bottom perspective view of an exemplary embodiment of the present invention, shown in use;

FIG. 2 is a top perspective view of an exemplary embodiment of the present invention;

DETAILED DESCRIPTION OF THE INVENTION

Figure 3:
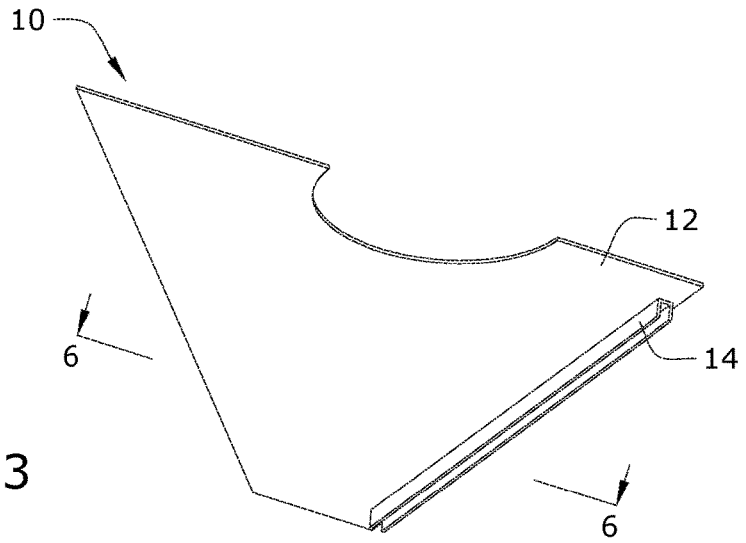
FIG. 3 is a bottom perspective view of an exemplary embodiment of the present invention.
Figure 4:
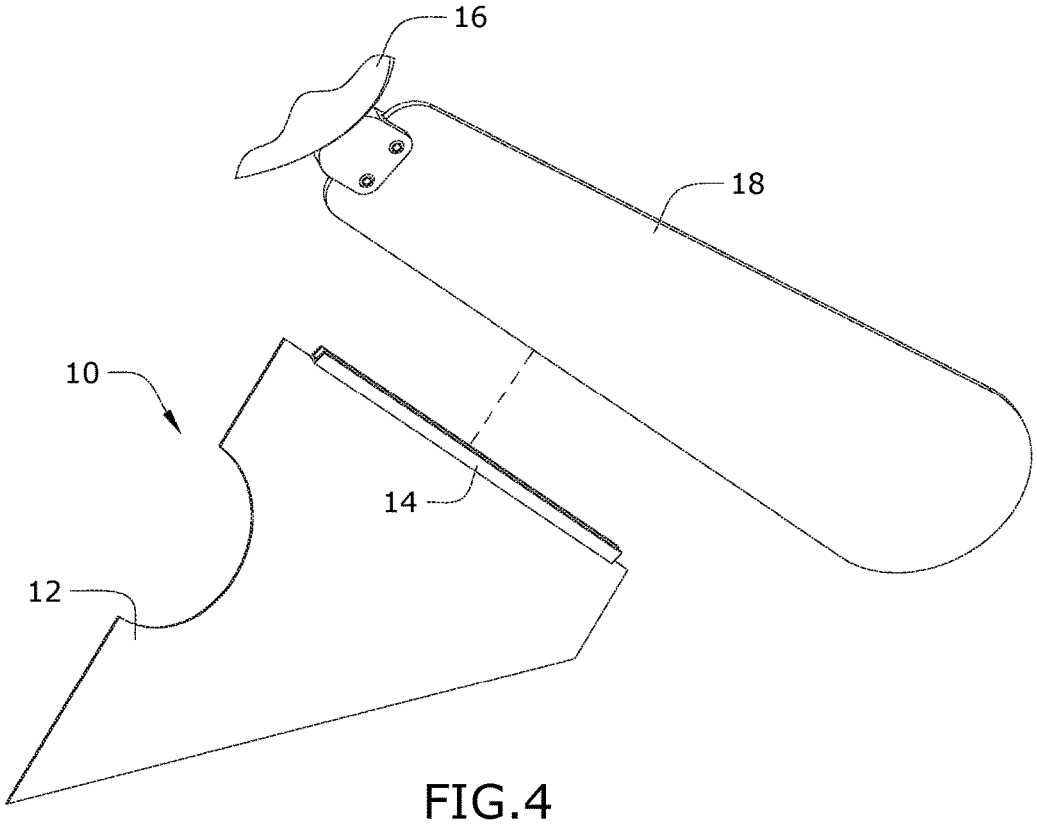
FIG. 4 is a bottom perspective exploded view of an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an accessory blade attachment adapted to removably attach to a ceiling fan blade of a ceiling fan. The accessory blade attachment may include a blade portion and a pivotally connected fan clip, wherein the fan clip removably attaches to the trailing edge of the ceiling fan blade so that the blade portion may improve the volume and direction of airflow generated by the ceiling fan.

Referring to FIGS. 1 through 8, the present invention may include an accessory blade attachment 10 adapted to removably attach to a ceiling fan blade 18 of a ceiling fan 16. The accessory blade attachment 10 may include a blade portion 12 and a pivotally connected fan clip 14. Each blade portion 12 may be made of a sheet of lightweight material that can be repeatedly bent without fracturing, such as polyethylene, polypropylene, vinyl, nylon, rubber, various plasticized materials and the like. The blade portion 12 may be configured in any shape or size, so long as the accessory blade attachment 10 functions in accordance with the present invention as described herein. Any shape will have at least one edge along a periphery of the blade portion 12. The accessory blade attachment 10 may be dimensioned and adapted to enable attached-to ceiling fan blades 18 to move a much greater volume of airflow without the need to increase the rotational velocity of the ceiling fan 16. The volumetric increase is proportional to the additional surface area afforded by the attached blade portion 12.

Figure 6:
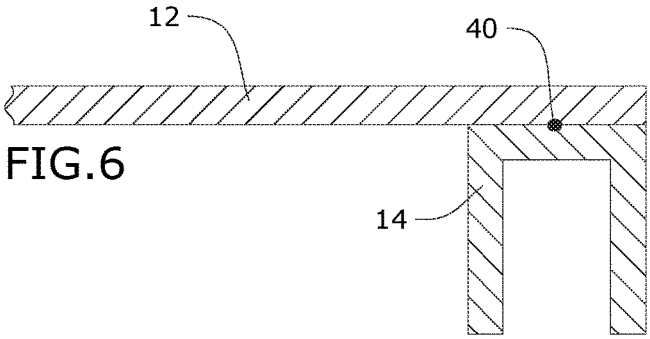
FIG. 6 is a section detail view of an exemplary embodiment of the present invention, taken along line 6-6 in FIG. 3.
Figure 6A:
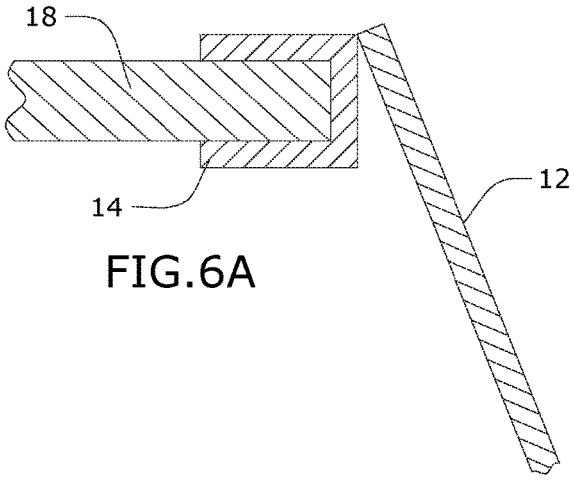
FIG. 6A is a section detail view of an exemplary embodiment of the present invention, taken along line 6A-6A in FIG. 1.

Moreover, the accessory blade attachment 10 may be dimensioned and adapted to enable attached-to ceiling fan blades 18 to redirect its airflow 20 so that a user does not have to reposition themselves or their furniture to claim the benefit of the airflow 20. The direction of the airflow may be controlled by the user manipulating a control pivot 40 disposed between each fan clip 14 and its cooperating blade portion 12, as illustrated in FIG. 6. The control pivot 40 may be removably locked so that the user can set a desired predetermined angle of incidence between the ceiling fan blade 18 and the attached blade portion 12.

Specifically, the blade portion 12 may be formed into a generally right-triangle shape, having a first leg 32 and a generally perpendicular second leg 34, wherein a circular notch 30 is formed into the first leg. In certain embodiments, a top vertex, where the hypotenuse and the second leg 34 intersect, may be defined by a top edge 36 that is generally perpendicular to the second leg 34, as illustrated in FIGS. 1 through 4. The circular notch 30, the top edge 36 and/or the combination of both may be dimensioned and adapted to improve the aerodynamics of the present invention when in use.

Figure 7:
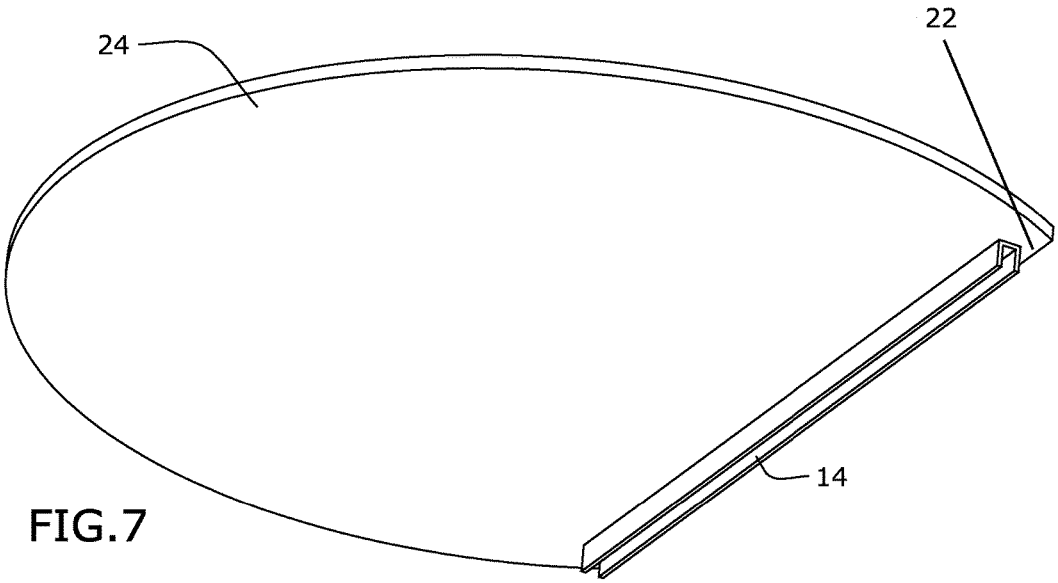
FIG. 7 is a bottom perspective view of an exemplary embodiment of the present invention.

In an alternative embodiment, the blade portion 12 may be formed into a generally half elliptical shape 24, as illustrated in FIG. 7. Here, the pivotally connected fan clip 14 may be disposed along the bisecting edge 22.

Figure 8:
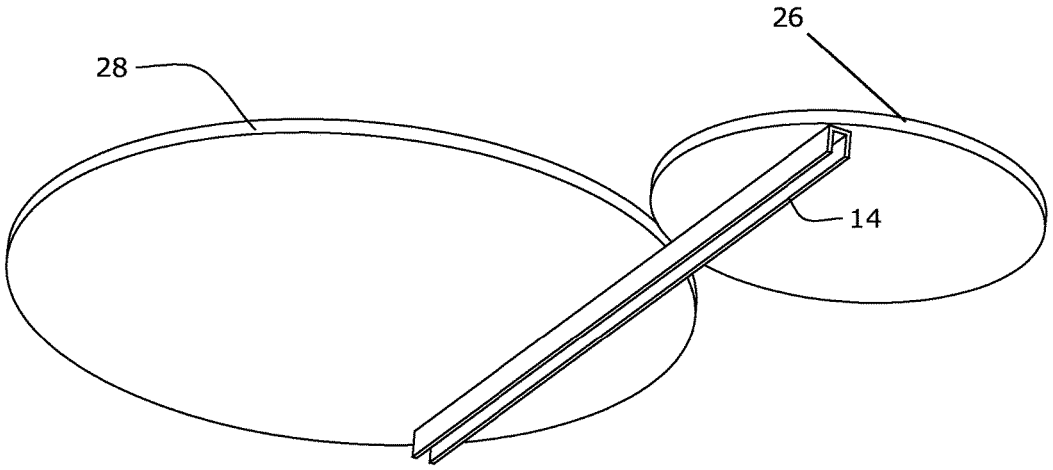
FIG. 8 is a bottom perspective view of an exemplary embodiment of the present invention.

In yet another alternative embodiment, the blade portion 12 may be formed into two abutting circulars shapes, wherein a first circular shape 28 is approximately twice the size as a second circular shape 26, as illustrated in FIG. 8. Here, the pivotally connected fan clip 14 may be disposed along both the first circular shape 28 and the second circular shape 26.

Figure 5:
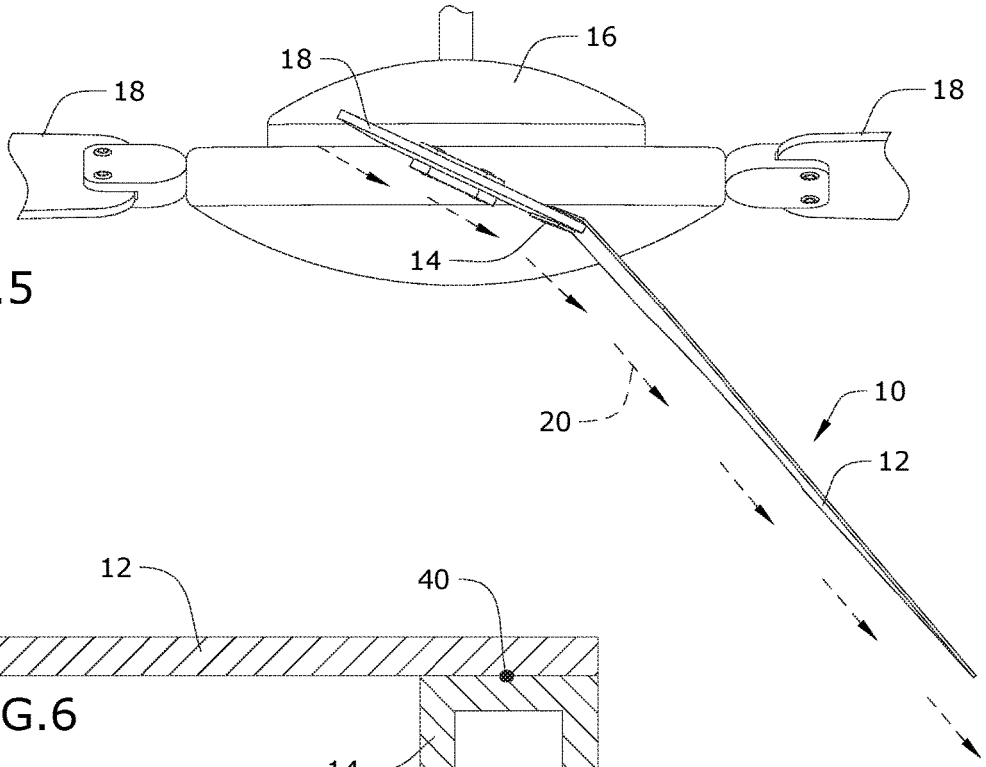
FIG. 5 is a side view of an exemplary embodiment of the present invention.

The fan clip 14 may be dimensioned and adapted to removably secure to an edge of the ceiling fan blade 18, which will most likely be the trailing edge, the trailing edge and an associated leading edge of the ceiling fan blade 18 defining a blade plane. The fan clip 14 may be pivotally connected to the blade portion 12 so as to enable a user to set a predetermined angle of incidence between the blade plane of the ceiling fan blade 18 and the blade portion 12 of the present invention so as to direct and/or redirect the airflow 20 as illustrated in FIG. 5. Typically, the fan clip 14 may be disposed along an edge of the blade portion 12, such as the second leg 34.

The method of using the present invention may include the following. The accessory blade attachment 10 may be provided. The user may removably attach at least one accessory blade attachment 10 to the ceiling fan 16 so as to increase the volume and/or direction of airflow 20. Typically, such an attachment will be strategically positioned on the trailing edge of the attached ceiling fan blade 18. The user may set the control pivot 40 at a predetermined angle of incidence between the ceiling fan blade 18 and the attached blade portion 12 to have the airflow 20 flow in a desired direction.

It should be understood, of course, that the foregoing relates to exemplary embodiments of the invention and that modifications may be made without departing from the spirit and scope of the invention as set forth in the following claims.

What is claimed is:

1. A ceiling fan blade attachment, comprising:

the ceiling fan blade having a blade plane defined by a leading longitudinal edge and a trailing longitudinal edge;

a fan clip for securing to the trailing longitudinal edge;

an attachment edge provided along the fan clip;

a blade portion having a generally triangular shape defined in part by a second leg;

the second leg pivotally connected along the attachment edge so that the blade portion pivots orthogonal relative to the blade plane and the trailing edge;

and a control pivot interconnecting the blade portion to the fan clip, the control pivot adapted to set an angle of incidence.

2. The ceiling fan blade attachment of claim 1, wherein the fan clip is disposed along a periphery of the blade portion.

3. The ceiling fan blade attachment of claim 1, wherein the set angle of incidence is ninety degrees.

4. The ceiling fan blade attachment of claim 1, wherein the fan clip is dimensioned to engage a substantial portion of a length of said trailing longitudinal edge.

5. The ceiling fan blade attachment of claim 1, wherein the triangular shape at a right angle relative to the blade plane when the angle of incidence is set to ninety degrees.

* * * * *